US008936719B2

(12) United States Patent
Gordon et al.

(10) Patent No.: US 8,936,719 B2
(45) Date of Patent: Jan. 20, 2015

(54) PROCESS FOR REMOVING SULPHUR FROM LIQUID HYDROCARBONS

(75) Inventors: John Gargano Gordon, Mardi (AU); Thomas Ruether, Ormond (AU); Friederike Elisabeth Agel, Heβdorf (DE); Andreas Bösmann, Heβdorf (DE)

(73) Assignee: Ultraclean Fuel Pty Ltd., Tuggerah, New South Wales (AU)

( * ) Notice: Subject to any disclaimer, the term of this patent is extended or adjusted under 35 U.S.C. 154(b) by 1308 days.

(21) Appl. No.: 12/293,767

(22) PCT Filed: Mar. 21, 2007

(86) PCT No.: PCT/AU2007/000350
§ 371 (c)(1),
(2), (4) Date: Oct. 8, 2010

(87) PCT Pub. No.: WO2007/106943
PCT Pub. Date: Sep. 27, 2007

(65) Prior Publication Data

US 2011/0203972 A1 Aug. 25, 2011

Related U.S. Application Data

(60) Provisional application No. 60/784,472, filed on Mar. 22, 2006.

(51) Int. Cl.
*C10G 53/04* (2006.01)
*C10G 53/14* (2006.01)
(Continued)

(52) U.S. Cl.
CPC ..... *C10G 53/04* (2013.01); *C10G 21/06* (2013.01); *C10G 21/08* (2013.01); *C10G 27/04* (2013.01); *C10G 53/14* (2013.01)
USPC ..... 208/222; 208/220; 208/238; 208/240

(58) Field of Classification Search
USPC ..... 208/219–222, 236, 238, 240
See application file for complete search history.

(56) References Cited

U.S. PATENT DOCUMENTS 6,160,193 A 12/2000 Gore
6,171,478 B1 1/2001 Cabrera et al.
(Continued)

FOREIGN PATENT DOCUMENTS

CN 1712497 A 12/2005
CN 101851529 A 1/2010
(Continued)

OTHER PUBLICATIONS

JR Minkel, "Pinching out Sulfer, Refining ways to turn heavy oil into sweet crude". Scientific American, Inc. 2006 pp. 25-27. www sciam. com.
(Continued)

*Primary Examiner* — Renee E Robinson
(74) *Attorney, Agent, or Firm* — Thorpe North & Western LLP

(57) ABSTRACT

A process for the deep desulfurisation of hydrocarbons (HC), in particular Natural Gas Condensate (NGC), and HC comprising diesel, pre-extracted diesel and naphtha, is described which is capable of reducing the sulfur content of these HC from 500 to 30 ppm. The process comprises contacting the hydrocarbon material with an oxidant selected from organic peroxy acids, organic peroxides, inorganic peroxides and mixtures thereof, in at least a stochiometric amount sufficient to oxidise a sulfur compound to a sulfone compound; contacting the hydrocarbon material with an aqueous extractant to allow at least a portion of the oxidised sulfur compounds to be extracted into the aqueous extractant, and separating the hydrocarbon material from the aqueous extractant to give a hydrocarbon material of reduced sulfur content. Optionally, the process may include a second and subsequent extractions with the aqueous extractant to further reduce sulfur content. A final extraction with an IL may be conducted. The invention also provides for substitution of the aqueous extractant with an IL in one or more of the other extraction steps. The extractants and by products generated during f01 oxidation can be recovered by simple distillation techniques.

33 Claims, 5 Drawing Sheets

(51) Int. Cl.

| | |
|---|---|
| ***C10G 21/06*** | (2006.01) |
| ***C10G 21/08*** | (2006.01) |
| ***C10G 27/04*** | (2006.01) |

(56) References Cited

U.S. PATENT DOCUMENTS

| | | | | |
|---|---|---|---|---|
| 6,274,785 | B1 | 8/2001 | Gore | |
| 6,277,271 | B1 | 8/2001 | Kocal | |
| 6,402,939 | B1 | 6/2002 | Yen et al. | |
| 6,406,616 | B1 | 6/2002 | Rappas et al. | |
| 6,596,914 | B2 | 7/2003 | Gore et al. | |
| 6,881,325 | B2 | 4/2005 | Morris et al. | |
| 7,001,504 | B2 | 2/2006 | Schoonover | |
| 7,175,755 | B2 | 2/2007 | De Souza | |
| 2002/0029997 | A1 | 3/2002 | Rappas et al. | |
| 2002/0148756 | A1 | 10/2002 | Morris et al. | |
| 2003/0085156 | A1* | 5/2003 | Schoonover | 208/230 |
| 2003/0149264 | A1 | 8/2003 | Bosmann et al. | |
| 2004/0096932 | A1 | 5/2004 | Kaftzik et al. | |
| 2004/0118750 | A1 | 6/2004 | Gong et al. | |
| 2004/0262578 | A1 | 12/2004 | Bosmann et al. | |
| 2005/0010076 | A1 | 1/2005 | Wasserscheid et al. | |
| 2005/0070717 | A1 | 3/2005 | Bosmann et al. | |
| 2005/0085671 | A1 | 4/2005 | Bohnen | |
| 2005/0090704 | A1 | 4/2005 | Roettger et al. | |
| 2005/0119516 | A1 | 6/2005 | Bollman | |
| 2005/0287677 | A1 | 12/2005 | Boesmann | |
| 2006/0063945 | A1 | 3/2006 | Hal | |
| 2007/0051667 | A1* | 3/2007 | Martinie et al. | 208/208 R |
| 2007/0227950 | A1* | 10/2007 | Martinie et al. | 208/217 |
| 2009/0065399 | A1 | 3/2009 | Kocal et al. | |
| 2009/0242459 | A1 | 10/2009 | Soloveichik et al. | |
| 2012/0018350 | A1 | 1/2012 | Lin et al. | |
| 2012/0091040 | A1 | 4/2012 | Sharma et al. | |

FOREIGN PATENT DOCUMENTS

| | | |
|---|---|---|
| DE | 19901524 | 7/2000 |
| DE | 19926924 | 1/2001 |
| DE | 10132526 | 1/2003 |
| DE | 10 2004 027196 | 12/2005 |
| DE | 102004033021 | 2/2006 |
| DE | 10 2004 024968 | 3/2006 |
| DE | 102005008406 | 4/2006 |
| EP | 0565324 A1 | 10/1993 |
| EP | 1182196 | 2/2002 |
| EP | 1182197 | 2/2002 |
| EP | 1679307 | 7/2006 |
| JP | 2001322953 | 11/2001 |
| WO | WO 9847616 | 10/1998 |
| WO | WO 0016902 | 3/2000 |
| WO | WO 0020115 | 4/2000 |
| WO | WO 0034211 | 6/2000 |
| WO | WO 0041809 | 7/2000 |
| WO | WO 01/48119 | 7/2001 |
| WO | WO 02/18518 | 3/2002 |
| WO | WO 0249992 | 6/2002 |
| WO | WO 02092204 | 11/2002 |
| WO | WO 03039719 | 5/2003 |
| WO | WO 03106379 | 12/2003 |
| WO | WO 2004 035542 | 4/2004 |
| WO | WO 2004 067487 | 8/2004 |
| WO | WO 2005014547 | 2/2005 |
| WO | WO 2005 023422 | 3/2005 |
| WO | WO 2005/113729 | 12/2005 |
| WO | WO 2005113702 | 12/2005 |
| WO | WO 2006087333 | 8/2006 |

OTHER PUBLICATIONS

Jeffrey S. Kanel, Ph.D., "Overview: industrial application of ionic liquids for liquid extraction". Power Point, J.S. Kanel & Associates, LLC. Chemical Industry Vision 2020 Technology Partnership Workshop. Sep. 11, 2003. pp. 1-15.

Shuguang Zhang et al., "Extraction Desulfurization and Denitrogenation of Fuels Using Ionic Liquids". Ind. Eng. Chem. Res. 2004,43, 614-622.

Ashish Deshpande et al., "Ultrasound-Assisted, Base-Catalyzed Oxidation of 4, 6-Dimethyldibenzothiophene in a Biphasic Diesel-Acetonitrile System". Energy & Fuels 2005, 19, 28-34. pp. 28-34.

Chongpin Huang et al., "Desulfurization of Gasoline by Extraction with New Ionic Liquids". Energy & Fuels 2004, 18, 1862-1864.

Wen-Hen Lo et al., "One-pot desulfurization of light oils by chemical oxidation and solvent extraction with room temperature ionic liquids". Green Chemistry, 2003, 5, pp. 639-642.

Wolfgang Arlt et al., "New classes of compounds for chemical engineering: ionic liquids and hyperbranched polymers". Technical University of Berlin, Institute fuer Verfahrenstechnik. 13 pages, (2003).

A. Bosmann et al., "Deep desulfurization of diesel fuel by extraction with ionic liquids". Chemcomm Communication, 2001, pp. 2494-2495. www.rsc.org/chemcomm.

* cited by examiner

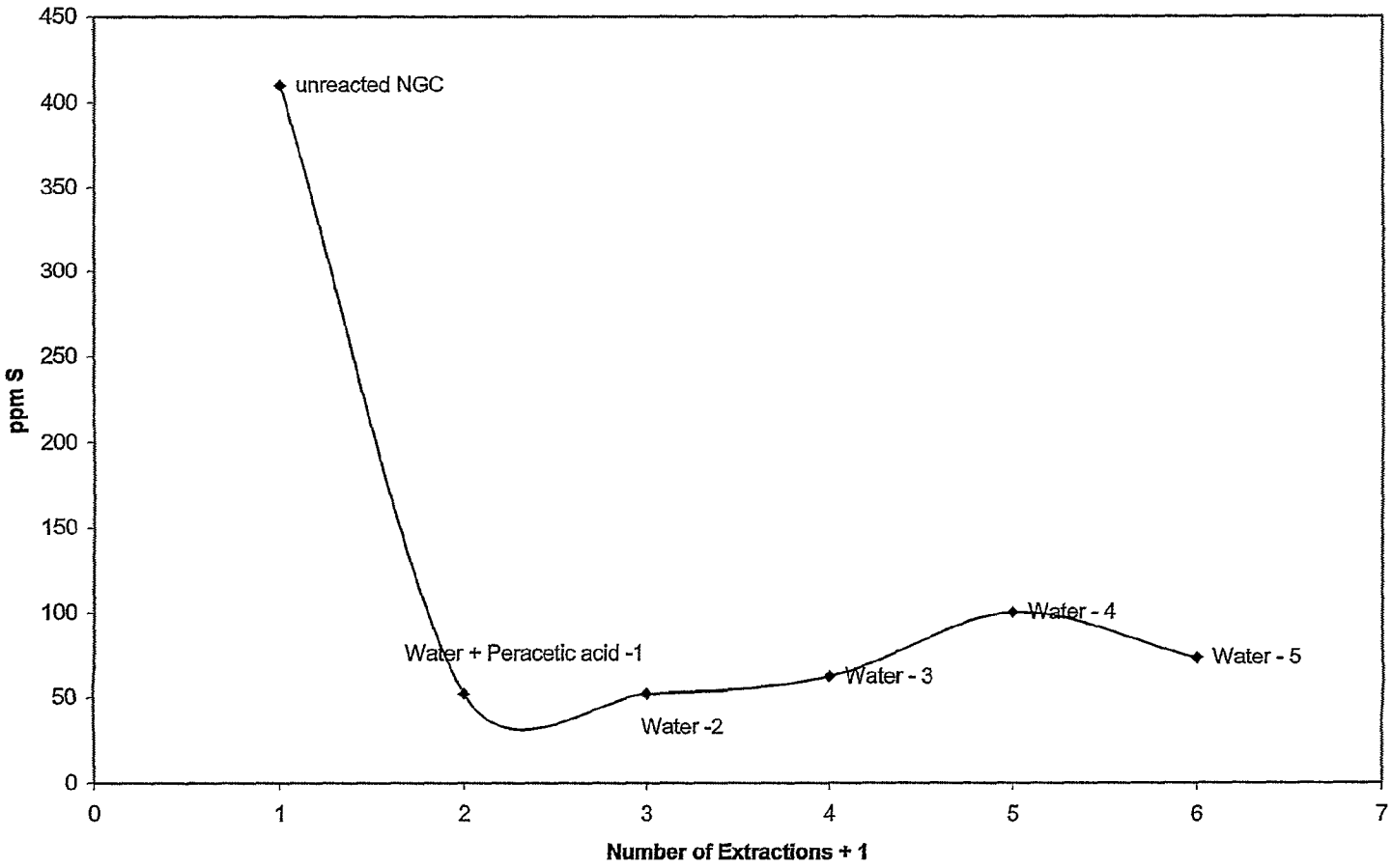
Figure 3: Extraction of NGC with Water

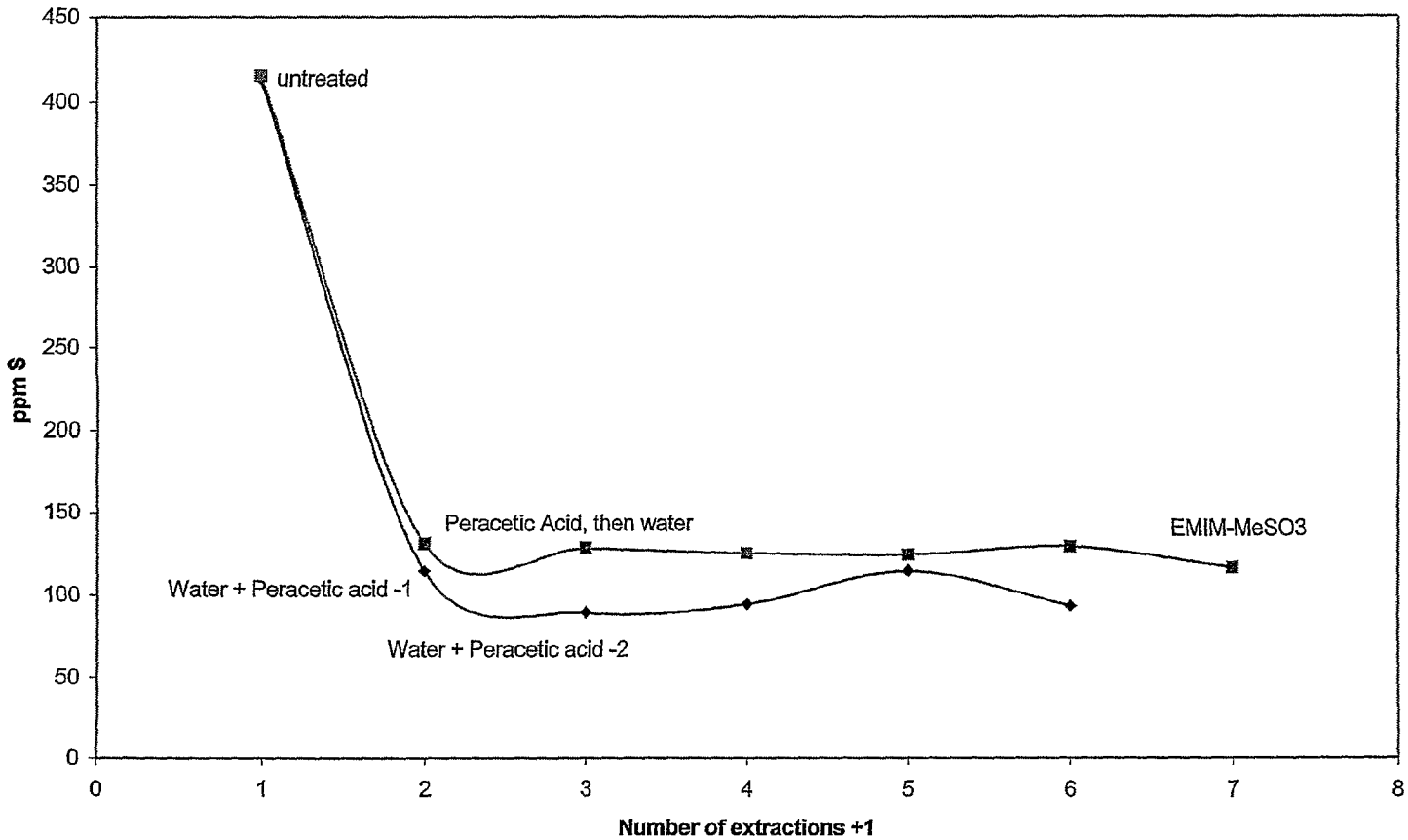
Figure 4: Extraction of NGC with water and (♦) 2nd equiv. of PAA and (■) final EMIM-S03Me wash

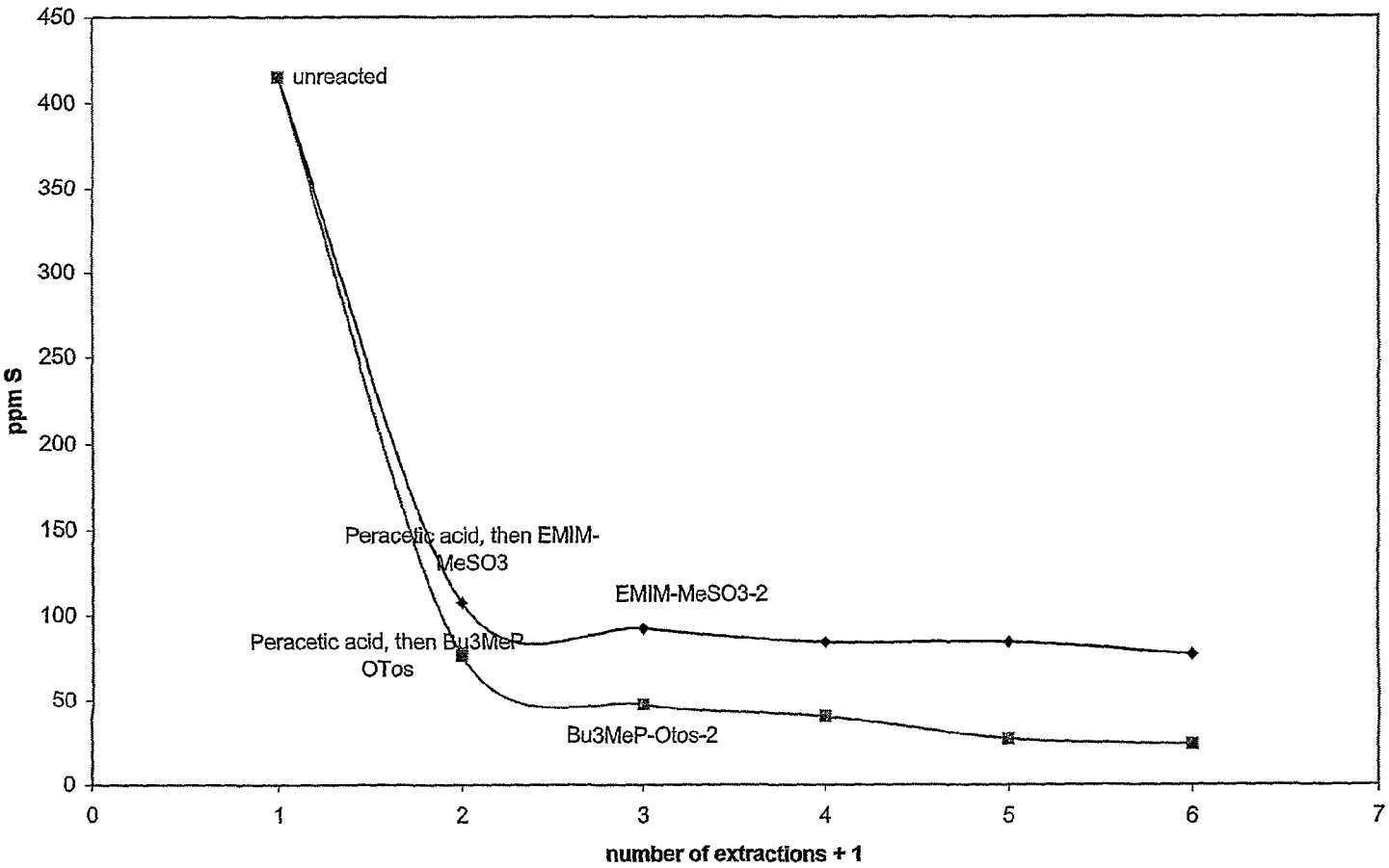
Figure 5: Extractions of NGC with EMIMSO3Me(♦) vs Bu3MePTos(■)

PROCESS FOR REMOVING SULPHUR FROM LIQUID HYDROCARBONS

CROSS-REFERENCE TO RELATED APPLICATIONS

The present application claims priority from United States of America Provisional Patent Application No. 60/784,472 filed on 22 Mar. 2006, the contents of which are incorporated herein by reference.

FIELD OF THE INVENTION

The present invention relates to the removal of sulfur compounds from hydrocarbon materials, in particular an oxidation and extraction process using water and/or an ionic liquid (IL) as an extractant.

BACKGROUND

The removal of sulfur compounds from fossil hydrocarbon (HC) mixtures down to ppm levels is of major technical importance at various levels in industry and society due to the fact that sulfur compounds or derivatives thereof can have negative effects on technical operations and the environment. Legislation in the European community currently limits the sulfur level in fuels such as gasoline and diesel to 50 ppm and below.

The necessity for refineries to furnish ultra low sulfur fuels challenged established desulfurisation technologies, e.g. hydro desulfurisation (HDS), and lead to development of new deep desulfurisation (DDS) processes. The existing HDS technologies have a number of shortcomings in the application of DDS due to very high operating temperatures and pressures and, more importantly, the use of unsustainable large quantities of hydrogen.

New DDS processes comprise of contacting fuels after conventional desulfurisation (HDS, Merox, etc.) with a sulfur selective extractant and in many cases a supporting additive which are immiscible with the fuel phase.

Technologies other than HDS for the reduction of sulfur levels in HC fuels, include (i) oxidative desulfurisation (ODS) and (ii) extraction with ionic liquids. Both areas focus on the DDS of liquid HCs such as fuel oils, diesel fuel, jet fuel, gasoline, and crude with contents of ≤1500 ppm.

The area of ODS involves in the first step the oxidation of S-contaminants to sulfoxides and/or sulfones which exhibit low solubility in HCs, and are thus available for extraction into a suitable polar solvent in a subsequent step. Oxidants in this process typically consist of peroxides, in most cases aqueous hydrogen peroxide solutions. For example, several patents (U.S. Pat. Nos. 5,310,479; 6,402,940; EP 0565,324 A) and publications (T. Kabe et al. Energy & Fuels 2000, 14, 1232; Zannikos et al. Fuel Process Technol. 1995, 42, 35; T. Aida et al. Prep.-Am. Chem. Soc., Div. Pet. Chem. 1994, 39, 623; T. Hirai et al. Ind. Eng. Chem. Res. 2002, 41, 4362; Stournas et al. Fuel Process Technol. 1995, 42, 35; A. R. Lucy et al. J. Mol. Catal. A: Chemical 1997, 117, 397) disclose the application of organic carboxylic acids, e.g. formic acid, in conjunction with aqueous hydrogen peroxide.

Although these processes are effective they have a number of shortcomings namely: (i) the use of the peroxide oxidant in stoichiometric excess (2.5 to 3.5 times in U.S. Pat. No. 6,402,940; up to 1000 times in T. Hirai et al. Ind. Eng. Chem. Res. 2002, 41, 4362); (ii) the use of large amounts of flammable and volatile organic compounds; (iii) difficulty in rendering these processes both economically and environmentally benign; and (iv) occasional difficulties in recovering additives such as oxidiser/extractants; e.g. formic acid forms an azetrop when mixed with water which is difficult to break and requires additional process steps.

The second area of IL technology comprises of contacting ionic liquids with HCs such as diesel fuels, in which they are immiscible (US Pat Appl. 20050010076A1; Wasserscheid et al. Chem. Commun. 2001, 2494; Zng et al. Green Chem. 2002, 4, 376, U.S. Pat. No. 7,001,504 Schoonover). After gravity separation of the S-laden IL extractant and repeated extraction steps, model fuels with S-levels<50 ppm are obtained. A similar technology uses a combination of ILs and hydrogen peroxide as an oxidiser for the DDS of light oil (Wei et al. Green Chem. 2003, 5, 639).

Whilst ionic liquids have been known for many years, they have only recently attracted great interest as versatile materials due to their unique properties. They are defined as being liquids which consist of ions only and are also referred to as molten salts. Their attractive properties include, amongst others, a very low vapour pressure, good electrical conductivity, high chemical robustness and solubility characteristics which can easily be controlled by varying the nature of either the cation or anion (P. Wasserscheid, W. Keim Angew. Chem. 112 (2000) 3926; T. Welton, Chem. Rev. 99 (1999) 2071; J, d. Holbrey, K. R. Seddon, Clean Products and Processes, 1 (1999) 223).

DISCLOSURE OF THE INVENTION

The present invention provides a process for reducing the sulfur content of a hydrocarbon material containing sulfur compounds, the process comprising:

contacting the hydrocarbon material with an oxidant selected from organic peroxy acids, organic peroxides, inorganic peroxides and mixtures thereof, in at least a stochiometric amount and for a time sufficient to oxidise a sulfur compound to a sulfone compound;

contacting the hydrocarbon material with an aqueous extractant for a time and under conditions sufficient to allow at least a portion of the oxidised sulfur compounds to be extracted into the aqueous extractant, and separating the hydrocarbon material from the aqueous extractant to give a hydrocarbon material of reduced sulfur content.

Optionally, the process may include a second and subsequent extractions with the aqueous extractant to further reduce sulfur content. A final extraction with an ionic liquid (IL) may be conducted.

The present invention also provides for substitution of the aqueous extractant with an IL in one or more of the other extraction steps.

The step of contacting the hydrocarbon material with the oxidant may be conducted prior to contacting with the extractant or concurrently with contacting with the extractant.

The aqueous extractant may be brine or water, preferably water.

When the hydrocarbon material comprises naphtha or a diesel fraction, the step of contacting the hydrocarbon material with the oxidant may be conducted after an initial extraction of the naphtha or diesel fractions with an ionic liquid extractant in order to selectively remove dienes which may otherwise deactivate the oxidation step.

The IL extractant may be an IL of the general composition $Q^+A^-$, where $Q^+$ is a quarternary ammonium or phosphonium cation and $A^-$ is an inorganic or organic anion, selected such that the IL is in a liquid state at the operating temperature and pressure of the process. For example, the ionic liquid can have a $Q^+$ cation selected from an alkyl pyridinium cation, an alkyl pyrrolidinium cation, an alkyl piperridinium cation, a di-alkyl imidazolium cation, a tri-alkyl imidazolium cation, tetra-alkylphosphonium and a tetra alkyl ammonium cation, and a $A^-$ anion selected from the group consisting of a halide anion, nitrate anion, alkylsulfate anions, alkylsulfonate anions, alkylsubstituted aryl sulfonates such as the p-toluene sulfonate anion, a triflate anion, a thiocyanate anion, a hexafluorophosphate anion, a tetrafluoroborate anion, dicyanamide anion, a bis(trifluormethanesulfonyl)imid anion, a halogenoaluminate anion, an organohalogenoaluminate anion, and mixtures thereof. More particularly, the ionic liquid can be those listed in table 2 below.

Preferably, the IL is selected so it has a miscibility gap when in contact with the hydrocarbon phase sufficient to minimise undesired losses of hydrocarbon from the hydrocarbon phase into the ionic liquid phase. It is also preferable that the selected ionic liquid has a miscibility gap when in contact with the hydrocarbon phase sufficient to minimise settling times for phase separation and dispersion of the ionic liquid into the hydrocarbon phase.

Suitable oxidisers include: organic peroxy acids such as carboxylic peracids, preferably carboxylic per acids having 2 or more carbon atoms, more preferably peracetic acid; organic peroxides such as t-butyl hydrogen peroxide; inorganic peroxides such as hydrogenperoxide, perborates, persulfates; and mixtures thereof such as carboxylic acid hydrogenperoxide mixtures. Preferably, the oxidiser is selected from peracetic acid, or a mixture of acetic acid and hydrogen peroxide. The amount of oxidiser is preferably a near stochiometric amount, more preferably one to two mol equivalent of peroxy acid or peroxide compound for the conversion of a sulfur compound to a sulfone.

In the oxidation of hydrocarbons comprising diesels, the amount of oxidant is preferably about 10 to about 20 mol equivalent of peroxy acid or peroxide compound. More specifically, when it is desired to reduce the amount of sulphur in hydrocarbon materials comprising, in particular, diesel, to low levels (eg below about 15 ppm), an additional oxidation step may be included in the process to oxidise the sulphur in compounds that are difficult to oxidise, for example thiophenes and benzothiophenes. This additional oxidation step may comprise one or a combination of two or more techniques selected from, but not limited to, ultrasonication, microwave irradiation and catalysis for deep oxidation. In the catalysis technique, the catalyst materials may comprise typical compounds known to promote such oxidations, including, but not limited to, catalyst systems based on early transition metal oxides, such as polyoxometalates and heteropolyoxometalates and catalyst systems based on late transition metals such as iron, ruthenium, rhodium, nickel, palladium and platinum. The oxidising agents used in the deep oxidation step may be selected from those described earlier and may be combined with the catalyst and the hydrocarbon in one single step, or be combined with the catalyst prior to contacting with the hydrocarbon for a time sufficient to generate the catalytically active species from the two components.

The extraction may be conducted at ambient temperature and atmospheric pressure. For removal of more complex sulfur compounds, slightly elevated temperatures may be beneficial. Extraction into water may, for example, be conducted up to the boiling point of water at a given pressure. A person skilled in the art would appreciate that for a volatile hydrocarbon, such as a natural gas condensate, an increase in pressure will be required under elevated temperatures to keep the NGC in the liquid phase.

The ratio of hydrocarbon to extractant may be about 10:1 or higher, preferably about 8:1, more preferably about 5:1. Smaller ratios are also viable, however, with smaller ratios the cost of the extractant for the process will be commensurately higher.

The process of the present invention is suitable for reducing the sulfur content of a range of hydrocarbons including natural gas condensates, light oils, diesel, gasoline, petroleum, jet fuels, and products of coal gasification and liquidification. The process has been found to be highly effective when used on hydrocarbons from actual oil refinery streams. Such hydrocarbons contain a variety of sulfur compounds of varying complexity and resistance to oxidation, depending on the source. This is in strong contrast to laboratory hydrocarbon model compositions which may include only limited selected sulfur compounds and where the limited selected composition of hydrocarbons impacts on the effectiveness of the process.

The innovation of the present invention offers several advantages over existing technologies: it is, in terms of economics and sustainability, superior to HDS technology since no hydrogen is involved and operations can be carried out under mild conditions, thus minimising capital investment and operational costs.

The consumption of the oxidising agent is maintained at a minimum due to the process of the present invention being effective with near stoichiometric amounts of oxidiser, whereas prior art processes operate with large excess amounts of oxidiser. Since peroxide oxidising agents represent a large cost factor, the present invention delivers considerable economic benefit in comparison to prior art ODS processes operating with excess amounts of oxidising agents.

Although the process according to this invention is not limited to the use of the oxidiser peracetic acid, the use of this agent has the benefit of generating acetic acid (AA) as a non-toxic and environmentally soft by-product of the reaction.

After complete oxidation of the S-compounds, the present invention may use water as the extracting solvent instead of frequently used volatile, flammable, and harmful organic solvents (such as DMF, ACN, DMSO, NMP). At the same time the water also serves to remove trace amounts of acid. Therefore additional amounts of bases such as hydroxide solutions are not needed.

A final polishing step can be carried out with an IL, which is, like water, an environmentally unproblematic extraction medium.

The extractant of the present invention can be separated and regenerated from the S-compounds in a simple manner by distillation techniques, thus avoiding large volume waste streams and, in case of IL extractants, also allows for economic operation.

In the present invention, distillative recovery of the AA stemming from the oxidation step is unproblematic, because AA, unlike formic acid, does not form an azeotrop with water. Thus after recovery, the AA can be re-used as a raw material for the generation of the oxidiser PA.

Therefore the method used in the present invention for the reduction of S-levels in liquid HC can be operated in a simple and economically viable manner with very low and easy to handle waste streams.

BRIEF DESCRIPTION OF THE DRAWINGS

FIG. 3 a graph of ppm Sulfur against the number of extractions for the extraction of natural gas condensates with water. The "+1' in the label of the X-axis refers to the fact that the first data point is the S-content of NGC prior to extraction. Similarly, the "+1' in the label of the X-axis for FIGS. 3 to 5 described below also refers to the fact that the first data point is the S-content of the hydrocarbon prior to extraction.

FIG. 4 a graph of ppm Sulfur against the number of extractions for the extraction of natural gas condensates with water and peracetic acid (diamond symbol) and extraction of natural gas condensates with peracetic acid followed by water and then EMIM-$SO_3$Me (square symbol).

FIG. 5 a graph of ppm Sulfur against number of extractions for the extraction of natural gas condensates with EMIM$SO_3$Me (diamond symbol) and $Bu_3$MeP-OTos (square symbol).

MODES FOR CARRYING OUT THE INVENTION

The present invention will now be further described by way of preferred embodiments which are intended to be illustrative only and not restrictive.

Figure 1:
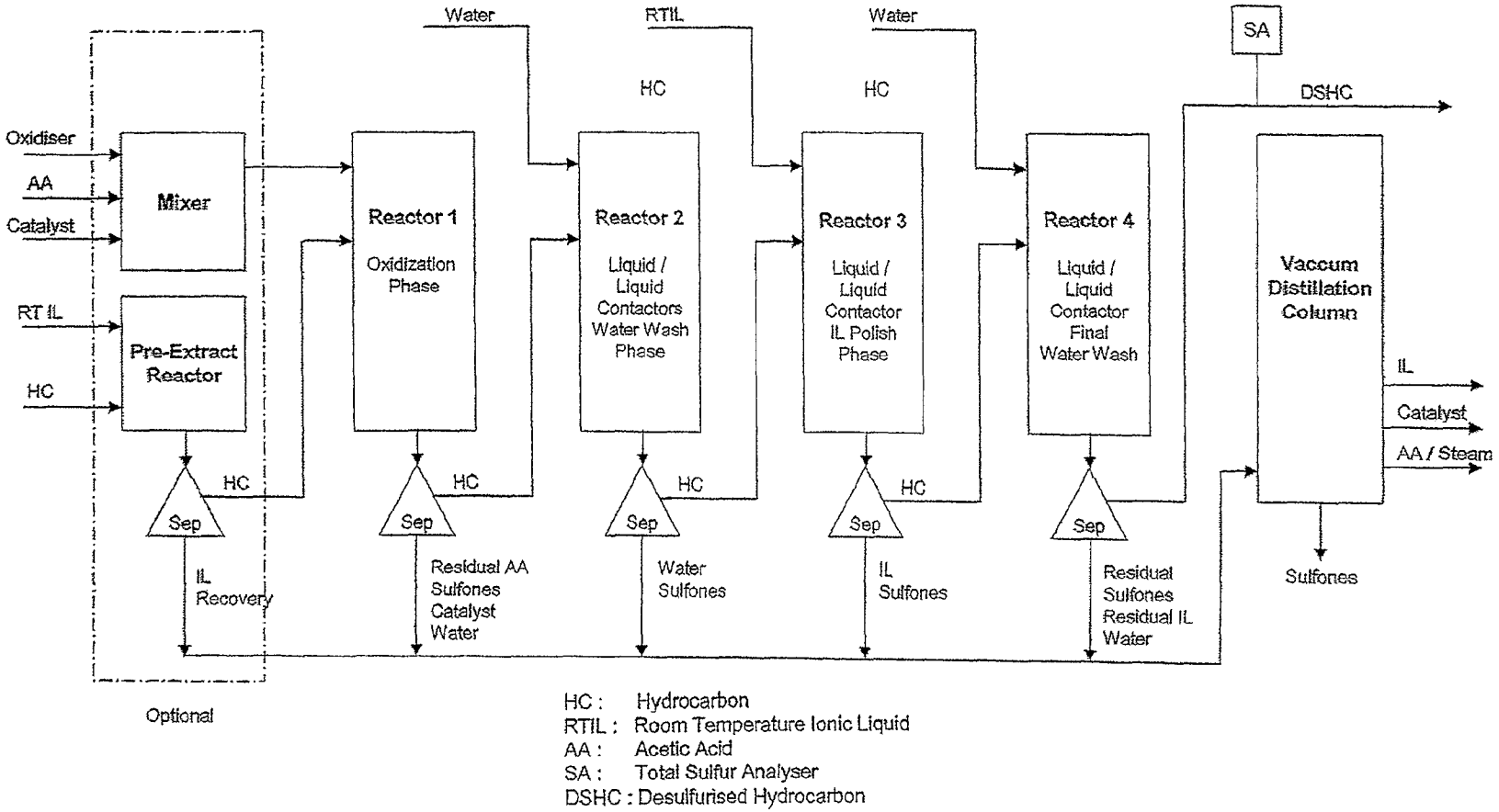
FIG. 1 a general scheme for one embodiment of the process of the present invention.

FIG. 1 shows a general scheme of one embodiment of the process of the present invention. In this embodiment, hydrocarbon material, water and oxidiser are thoroughly mixed for a selected period of time. The mixture is then allowed to settle so that two distinct layers may form. The lower layer which contains the majority of oxidised sulfur compounds is removed, preferably for recycling. The upper layer may be sampled at this point to analyse for sulfur content. If desired, this layer may be taken as the final product or purified further. For further purification, the extraction procedure may be repeated one or more times using water. A final extraction step may be conducted using IL.

Figure 2:
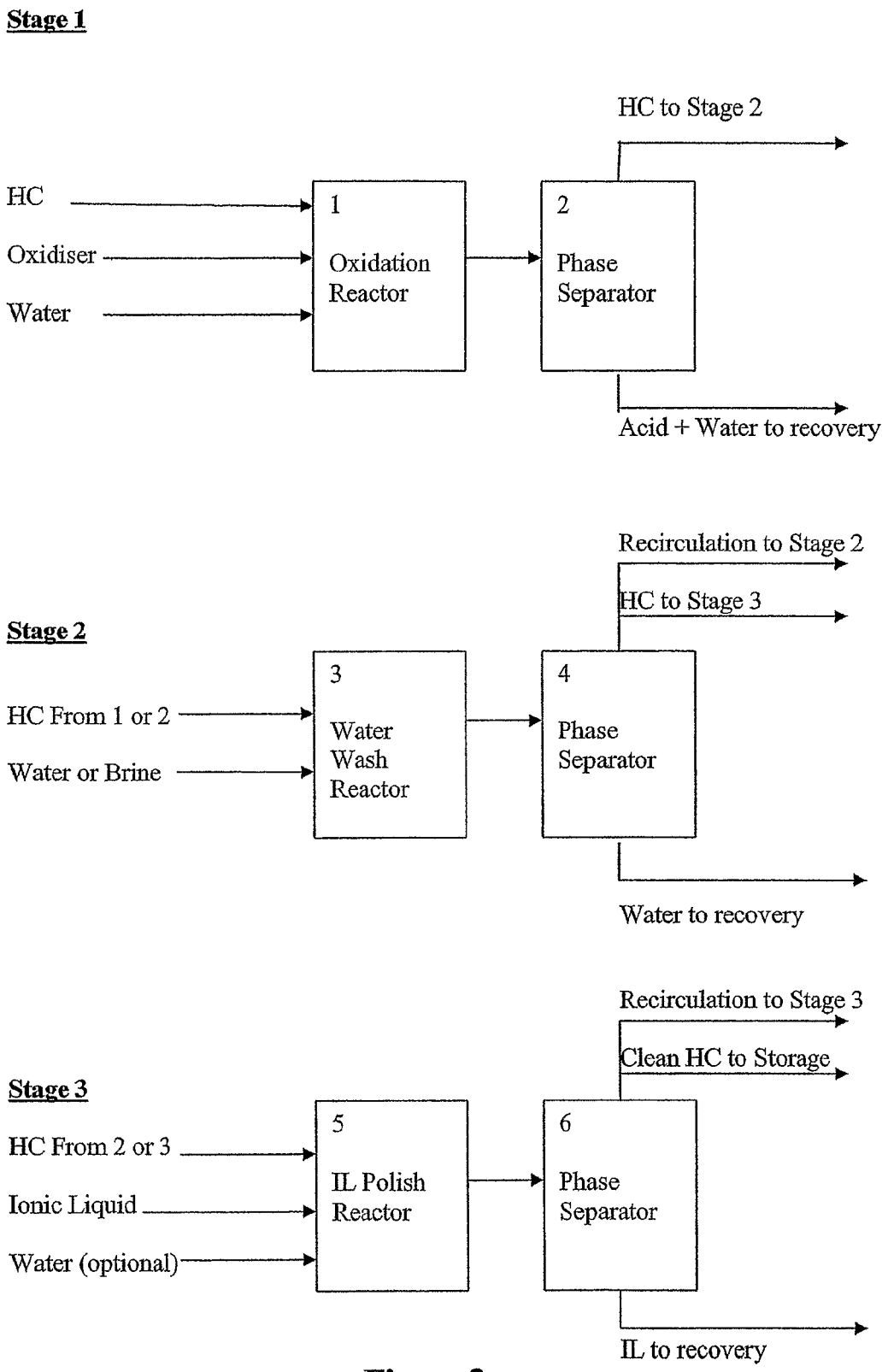
FIG. 2 a general scheme for another embodiment of the process of the present invention.

FIG. 2 shows an embodiment of the invention in three stages. In a first stage, hydrocarbon material, water and oxidiser are thoroughly mixed for a selected period of time. The mixture is then allowed to settle so that two distinct layers may form. The lower layer which contains the majority of oxidised sulfur compounds is removed and processed to recover water and acid. The upper hydrocarbon layer is transferred to another reactor (stage 2) and mixed with water or brine for a selected period of time then allowed to settle. The lower layer is removed and processed to recover water. The upper layer may be returned to the water wash reactor for one or more additional extractions in water then transferred to stage 3 for extraction with an IL. In stage 3, the HC is mixed with IL for a selected period of time then allowed to settle. The lower layer is removed and processed to recover IL. The upper layer may be returned to the IL reactor for one or more additional extractions in IL.

A number of experiments using NGC hydrocarbon material to illustrate the present invention were conducted as described below. For all experiments, gas chromatographic analysis was performed to confirm the identity of the NGC before and after extraction. A Shimadzu GC2014 was used under the following conditions:

Autoinjector AOC20i
Detector: FID
Carrier gas: N2
Makeup gas: Air
Split: 100
Column oven temperature program: initial 30° C., 15 min hold at 30° C., ramp at 10K/min to 300° C., hold for 10 min.
Column: Supreme-5 (like DB-5), 25 m, Phenylpolysilphenylensiloxan, by CS-Chromatographie Service
Injection volume: 1 uL, undiluted
volume flow 0.51 mL/min
linear velocity 15.1 cm/s All tests were conducted on refinery streams rather than sample models created in a laboratory, in particular on NGC streams containing 400 to 500 ppm S. It will be appreciated that NGC generally comprise a mixture of linear and branched saturated hydrocarbons with a low content of aromatic and olefinic (unsaturated) hydrocarbon. The major constituents of NGC are C5 and C6 fractions (n/iso-pentanes, n/iso-hexanes). An analytical report on a sample of NGC after treatment to remove inorganic sulphur and prior to treatment in the present process is provided in Table 1.

TABLE 1

Summary Report

| Group Type | Total (mass %) | Total (vol %) |
|---|---|---|
| Paraffins | 38.826 | 39.792 |
| I-paraffins | 47.259 | 48.609 |
| Olefins | 0.000 | 0.000 |
| Naphthenes | 11.217 | 9.584 |
| Aromatics | 2.698 | 2.014 |
| Total C14+ | 0.000 | 0.000 |
| Total Unknowns | 0.000 | 0.000 |
| Grand Total | 100.00 | 100.00 |
| Oxygenates | | |
| Total | 0.000 (mass %) | 0.000 (vol %) |
| Total Oxygen Content | 0.000 (mass %) | |
| Multisubstituted Aromatics | 0.391 (mass %) | 0.294 (vol %) |
| Average Molecular Weight | 77.764 | |
| Relative Density | 0.651 | |
| Vapour Pressure calculated RVP (EPA method) | 11.87 (psi @ 100° F.) | |
| Octane Number (calc) | 75.64 | |

| Boiling Point (estimated) | IBP: | T10: | T50: | T90: | FBP: |
|---|---|---|---|---|---|
| | 49.10° F. | 82.11° F. | 96.91° F. | 197.33° F. | 282.42° F. |

| | |
|---|---|
| Percent Carbon | 83.929 |
| Percent Hydrogen | 16.071 |
| Bromine Number (calculated) | 0.000 |

Molecular Weight and Relative Density Data

| Group | Average Molecular Weight | Average Relative Density |
|---|---|---|
| C1 | 0.000 | 0.000 |
| C2 | 0.000 | 0.000 |
| C3 | 0.000 | 0.000 |
| C4 | 58.124 | 0.579 |
| C5 | 72.109 | 0.625 |
| C6 | 85.266 | 0.688 |
| C7 | 98.397 | 0.731 |
| C8 | 112.466 | 0.739 |
| C9 | 127.488 | 0.734 |
| C10 | 142.286 | 0.732 |
| C11 | 0.000 | 0.000 |
| C12 | 0.000 | 0.000 |
| C13 | 0.000 | 0.000 |
| Total Sample | 77.764 | 0.651 |

Estimated Octane Number
(Calculated from Individual Component Values)

| Contribution to Total by: | |
|---|---|
| Paraffins: | 19.85 |
| Isoparaffins: | 43.58 |

TABLE 1-continued

| Summary Report | |
|---|---|
| Olefins: | 0.00 |
| Naphthenes: | 9.10 |
| Aromatics: | 3.11 |
| Oxygenates: | 0.00 |

General Procedure for Oxidative Extraction of NGC with Water

Initial S-content of NGC was determined by using a S-sensitive X-ray Fluorescence detector. A stoichiometric amount (based on initial S-content) of the oxidiser peracetic acid (PAA) was added to a 5:1 by volume mixture of NGC and water (typically 100:20 ml, several up-scaling experiments were also carried out on a multi litre scale) at ambient temperature under vigorous stirring in a sealed glass reaction vessel. Thorough mixing could be achieved either mechanically or, more efficiently, by ultrasonication. Contact times can vary from 0.25 to 48 h. The biphasic mixture was allowed to settle until clear separation into two layers was observed. The lower aqueous layer containing AA and the majority of the oxidised S-compounds was separated and transferred to recycling. The upper NGC layer was sampled for sulfur analysis (S-sensitive X-ray Fluorescence detector).

The same procedure for mixing and separating but without prior addition of PAA oxidiser (except in entry 9, Table 2) was applied in subsequent (multiple) extractions.

General Procedure for Oxidative Extraction of NGC with Ionic Liquids

Initial S-content of NGC was determined by using a S-sensitive X-ray Fluorescence detector. A stoichiometric amount (based on initial S-content; e.g. 415 ppm) of the oxidiser PAA was added to a 5:1 by volume mixture of the NGC and an IL (typically 100:20 ml, several up-scaling experiments were also carried out on a multi litre scale) at ambient temperature under vigorous stirring in a sealed glass reaction vessel. Thorough mixing of the biphasic system could be achieved either mechanically or, more efficiently, by ultrasonication. Contact times can vary from 0.25 to 48 h. Alternatively, the NGC can be contacted with the PAA for a set period of time prior to the addition of IL. The biphasic mixture was allowed to settle until clear separation into two layers was observed. The lower IL layer containing AA and the majority of the oxidised S-compounds was separated and transferred to recycling. The upper NGC layer was sampled for sulfur analysis (S-sensitive X-ray Fluorescence detector).

The same procedure for mixing and separating but without prior addition of PAA oxidiser was applied in subsequent (multiple) extractions.

Results of the oxidation/extraction experiments are summarised in Tables 2 and 3. A key to symbols in these tables is provided below:

Key

"Extr.capab." is extraction capability; defined as (1−ppm Sulfur after extraction/ppm Sulfur prior to extraction).

G-08 is a Methyl-bis(polyethoxyethanol)-coco-ammonium chloride, where "poly" means 5-8.

G-04 is a Polyoxypropylen-methyl-diethyl-ammonium chloride, where "poly" means 3-6.

S222-BTA is Tri-ethyl-sulfonium-bis(trifluormethanesulfonyl)imid.

N1114-BTA is Butyl-trimethylammonium-bis(trifluormethanesulfonyl)imid.

N4446-Br is Tributylhexylammonium-bromide.

HO-EMIM-BTA is hydroxyethylmethylimidazolium-bis(trifluormethanesulfonyl)imid

BMPyrr-MeSO4 is buthylmethylpyrrolidinium-methylsulphate

Bu3MeP-OTos is Tributylmethylphosphonium-p-toluene sulfonate.

The RMIM-X nomenclature denotes Alkyl-methylimidazolium salts, where E is ethyl, B is butyl, Hex is hexyl, and O is octyl.

On the Anion side X: MeSO3 is Methyl sulfonate, OTos is p-toluene sulfonate, SCN is thiocyanate, DCN is dicyanamide, Br is bromide, and BTA and $NTf_2$ is bis(trifluormethanesulfonyl)imid.

TABLE 2

| Entry | Oxidiser/Extractant | ppm S | extr. capab. |
|---|---|---|---|
| | Initial | 450 | |
| 1 | Water + Peracetic acid | 130 | 0.711 |
| | Initial | 390 | |
| 2 | Water + 2xPeracetic acid | 77 | 0.803 |
| | Initial | 410 | |
| 3 | Water + Peracetic acid -1 | 52 | 0.873 |
| 4 | Water - 2 | 52 | 0.000 |
| 5 | Water - 3 | 62 | −0.192 |
| 6 | Water - 4 | 100 | −0.613 |
| 7 | Water - 5 | 73 | 0.270 |
| | Initial | 413 | |
| 8 | Water + Peracetic acid -1 | 114 | 0.724 |
| 9 | Water + Peracetic acid -2 | 89 | 0.219 |
| 10 | Water - 3 | 94 | −0.056 |
| 11 | Water - 4 | 94 | 0.000 |
| 12 | Water - 5 | 93 | 0.011 |
| | Initial | 413 | |
| 13 | Water + Peracetic acid 6 h | 109 | 0.736 |
| 14 | Water + Peracetic acid 12 h | 104 | 0.748 |
| 15 | Water + Peracetic acid 24 h | 97 | 0.765 |
| 16 | Water + Peracetic acid 36 h | 108 | 0.738 |
| 17 | Water + Peracetic acid 48 h | 96 | 0.768 |
| | Initial | 415 | |
| 18 | Peracetic Acid, then water | 131 | 0.684 |
| 19 | Water-2 | 128 | 0.023 |
| 20 | Water-3 | 125 | 0.023 |
| 21 | Water-4 | 124 | 0.008 |
| 22 | Water-5 | 129 | −0.040 |
| 23 | EMIM-MeSO3 | 116 | 0.101 |

TABLE 3

| Entry | Extractant and/or oxidiser | ppm S | extr. capab. | initial ppm S |
|---|---|---|---|---|
| 1 | EMIM-MeSO3 | 390 | 0.025 | 400 |
| 2 | EMIM-OTos | 460 | −0.150 | 400 |
| 3 | EMIM-EtSO4 | 380 | 0.050 | 400 |
| 4 | EMIM-NTf2 | 390 | 0.025 | 400 |
| 5 | EMIM-MeSO4 | 370 | 0.075 | 400 |
| 6 | BMIM-MeSO4 | 380 | 0.050 | 400 |
| 7 | HexMIM-MeSO4 | 370 | 0.075 | 400 |
| 8 | OMIM-MeSO4 | 370 | 0.075 | 400 |
| 9 | G-08 | 350 | 0.125 | 400 |
| 10 | HOEtNH3-Formiat | 390 | 0.025 | 400 |
| 11 | EMIM-SCN | 420 | 0.045 | 440 |
| 12 | EMIM-DCN 14 mL | 430 | 0.023 | 440 |
| 13 | BMIM-BF4 | 420 | 0.045 | 440 |
| 14 | OMIM-Br | 420 | 0.045 | 440 |
| 15 | N4446-Br | 390 | 0.114 | 440 |
| 16 | N1114-BTA | 420 | 0.045 | 440 |
| 17 | BMPyrr-MeSO4 | 420 | 0.045 | 440 |
| 18 | G-04 | — | — | 440 |
| 19 | HO-EMIM-BTA | 420 | 0.045 | 440 |
| 20 | S222-BTA | 420 | 0.045 | 440 |
| 21 | Bu3MeP-OTos | 420 | 0.045 | 440 |
| 22 | N4446-Br | 350 | 0.167 | 420 |
| 23 | G-08 | 370 | 0.119 | 420 |

TABLE 3-continued

| Entry | Extractant and/or oxidiser | ppm S | extr. capab. | initial ppm S |
|---|---|---|---|---|
| 24 | OMIM-MeSO4 + Peracetic acid | 140 | 0.667 | 420 |
| 25 | Bu3MeP-OTos + Peracetic acid | 130 | 0.690 | 420 |
| 26 | Bu3MeP-OTos + Peracetic acid - 1 | 88 | 0.804 | 450 |
| 27 | Bu3MeP-OTos - 2 | 58 | 0.341 | |
| 28 | Bu3MeP-OTos - 3 | 51 | 0.121 | |
| 29 | Bu3MeP-OTos - 4 | 44 | 0.137 | |
| 30 | Bu3MeP-OTos - 5 | 32 | 0.273 | |
| 31 | Peracetic acid, then EMIM-MeSO3-1 | 107 | 0.742 | 415 |
| 32 | EMIM-MeSO3-2 | 92 | 0.140 | |
| 33 | EMIM-MeSO3-3 | 84 | 0.087 | |
| 34 | EMIM-MeSO3-4 | 84 | 0.000 | |
| 35 | EMIM-MeSO3-5 | 77 | 0.083 | |
| 36 | Peracetic acid, then Bu3MeP-OTos-1 | 76 | 0.817 | 415 |
| 37 | Bu3MeP-OTos-2 | 47 | 0.382 | |
| 38 | Bu3MeP-OTos-3 | 40 | 0.149 | |
| 39 | Bu3MeP-OTos-4 | 27 | 0.325 | |
| 40 | Bu3MeP-OTos-5 | 24 | 0.111 | |

Discussion of Results for Experiments Using NGC Hydrocarbon Material

Extending contact times in the oxidation step beyond 6 h does not significantly impact on the result (Table 2, entries 13-17).

In the first oxidation and extraction step the S-level is already reduced by 72 to 87% (Table 2, entries 1, 3, and 8). The NGC having been desulfurised once is contacted in subsequent multiple steps (up to 5) with 1/5 volumes of water under the above conditions to achieve further reduction of the S-levels and to remove trace amounts of residual acid. After the $2^{nd}$ step, extractions enter into a saturation phase approaching S-levels of 50 ppm (FIG. 3).

The difficulty in further removing residual amounts of S is probably not due to incomplete oxidation. In a separate test (see FIG. 4) a stoichiometric amount of oxidiser was also added in the $2^{nd}$ extraction test, extractions 3 to 6 being with water only (see the line in FIG. 4 labeled "water and 2nd equiv. of PAA" (diamond symbol). This did not significantly impact on the overall S-reduction suggesting that solubility issues play an important role.

Oxidation/Extraction experiments were also carried with a selection of ILs. In initial tests (Table 3) ILs were screened for their extraction capability towards 400 to 500 ppm sulfur samples of NGC, and the ILs EMIM-SO3Me and Bu3MeP-Tos were found to be the most effective in terms of extraction capability, phase separation, and stability towards aqueous media (Table 3, entries 1-23).

However, this method of extraction is only effective in conjunction with the use of an oxidiser, e.g. PAA (Table 3, entries 24, 25)

Employing Bu3MeP-OTos as the extractant allowed reducing S-levels in the liquid HC below 30 ppm (Table 3, entries 36-40, FIG. 5). Since the same amounts of oxidiser with respect to the initial S-level were used in these tests, the results suggest miscibility properties are responsible for extraction limits rather than incomplete oxidation of the S-species in the first step.

In case of Bu3MeP-OTos, settling times of the biphasic mixture were considerably longer than with other ILs, e.g. EMIM-SO3Me. Hence differences in the sharpness of phase separation impact on the recovery of NGC after multiple extractions. When EMIM-SO3Me was employed 1.6 wt % NGC were found in the IL, whereas 8 to 10% were detected in for Bu3MeP-OTos.

For an economical viable process it is vital that the S-laden extractant can be regenerated in a simple manner. The present invention employs economical steam and mild vacuum distillation techniques to remove S-compounds from the extractant. Due to their high boiling point and stability ILs remain behind and unaffected with recoveries of ~95%, whereas the S-compounds move into the steam phase. This generates a simple to handle waste stream.

Other suitable techniques for regeneration of the extractants include but are not limited to, flash distillation with a stream of inert gas such as nitrogen, steam distillation with a steam stripper column and fraction distillation.

Thus EMIM-SO3Me and Bu3MeP-OTos which had been regenerated by steam distillation showed reproducible extraction capabilities in subsequent tests similar to those observed for the fresh material. No degradation of the ionic liquid extractants was observed under these conditions and the identity of the ionic liquid extractants was established by suitable analytical methods (e.g. NMR, HPLC).

The ability of water and ILs for the DDS of said HCs was combined in a new oxidation/extraction process comprising of the steps (i) oxidation in an PAA/water medium, (ii) multiple extractions/washings with water, and (iii) a final polishing step for further reducing the S-content with an IL. According to test results (Table 2, entry 22-23; FIG. 4) S-levels were further reduced by 10% by employing an IL after water extraction had entered saturation.

In addition, the use of water as an extractant following oxidation with peracetic acid compared well with the results using an ionic liquid extract (Table 2, entries 18-23 compared to Table 3, entries 31-35 and 36-40). For these entries, 8 mmol (1.68 ml) of peracetic acid was added to 400 ml of NGC with an initial sulfur content of 415 ppm. Subsequent extractions were conducted with water or ionic liquid as indicated. The use of water as the sole extractant (or minimal use of an IL as the extractant for the final polishing step—eg entry 23) is advantageous from both an economic and environmental perspective.

A number of experiments were also conducted using diesel, pre-extracted diesel and naphtha hydrocarbons. These will now be discussed further below.

General Procedure for the Oxidative Extraction of Diesel, Pre-Extracted Diesel and Naphtha Hydrocarbons Tests were conducted on real diesel, from refinery streams which were collected before the subjection to any deep desulfurisation processes. The tests on these materials were carried out in a similar manner as described for the NGC and illustrated in FIGS. 1 and 2. However, some variations were made to process parameters such as temperature, stoichiometry of oxidiser and succession of extractants.

The diesel sample and an excess stoichiometric amount (Table 4, based on initial S-content) of the oxidiser (e.g. peracetic acid [32 wt % solution in dilute acetic acid]; $H_2O_2$ [30 wt % in dilute acetic acid]) were contacted for a defined time under vigorous stirring at a defined temperature (Table 4) in a reaction vessel equipped with a reflux condenser system of a capacity sufficient to prevent losses of any volatile components of the diesel material. Thorough mixing of the biphasic system was achieved either mechanically, or, more efficiently when operating on a larger scale, by means of a counter current mixing system, rotating mixer, microwave radiation, or by ultrasonication.

The tests were conducted on a scale of a few 100 ml up to several litres. The oxidation step was carried out with either PAA or a mixture of hydrogen peroxide and acetic acid, the latter allowing for a more economical operation by avoiding the use of expensive premanufactured PAA. Alternatively, the oxidation may be carried out in presence of a catalyst selected from typical compounds known to promote such oxidations, including, but not limited to, catalyst systems based on early transition metal oxides, such as polyoxometalates and heteropolyoxometalates and catalyst systems based on late transition metals such as iron, ruthenium, rhodium, nickel, palladium and platinum. In some of the tests the diesel phase was immediately contacted with the oxidiser/catalyst mixture, whereas in some other tests the catalyst was pre-treated with the oxidiser for a set period of time.

After completion of the oxidation step, a first water wash step was conducted in which water was added under stirring to give a mixture of the diesel and aqueous phase. IL extractions were conducted after separation of the aqueous phase. After completion of all (typically 6) IL extractions, a final water wash followed.

The biphasic mixture was allowed to settle until separation into two layers was observed. The lower aqueous layer containing AA and oxidised S-compounds was separated and transferred to recycling. The upper diesel layer was sampled for sulfur analysis.

The same procedure for mixing and separating but without prior addition of the oxidiser was applied in subsequent (multiple) extractions with an ionic liquid followed by a final water wash.

Results are shown in Table 4.

TABLE 4

| | | Oxidant | Reaction. | Total oxidiser | IL Extractions | | Water Wash | | Total |
|---|---|---|---|---|---|---|---|---|---|
| Run # | Feed | Type (Conc). | Time Minutes | Stoic. mol equi | No. | Temp. ° C. | No. | Temp. ° C. | Sulfur ppm |
| 1 | diesel | PAA (32%) | 60 | 5 | 3 | Rm | 3 | Rm | 57 |
| 2 | diesel | PAA (32%) | 60 | 10 | 5 | Rm | 1 | Rm | 32 |
| 3 | diesel | PAA (32%) | 60 | 10 | 6 | Rm | 1 | Rm | 80 |
| 4 | diesel | | | | 6 | Rm | 1 | Rm | 304 |
| 5 | diesel | PAA (32%) | 90 | 10 | 6 | Rm | 1 | Rm | 20 |
| 6 | diesel | | | | 10 | Rm | 1 | Rm | 163 |
| 7 | diesel | PAA (32%) | 90 | 20 | 6 | Rm | 1 | Rm | 15 |
| 8 | diesel | | | | 10 | 55 | 1 | 55 | 221 |
| | pre-ext. diesel | PAA (32%) | 90 | 20 | 6 | 60 | 1 | 60 | 58 |
| 9 | naptha | PAA (32%) | 60 | 2.5 | 6 | 50 | 1 | 50 | 189 |
| 10 | naptha | PAA (32%) | 60 | 10 | 6 | 45 | 1 | 45 | 190 |
| 11 | diesel | | | | 8 | 55 | | | |
| | pre-ext. diesel | | | | 2 | 55 | 1 | 55 | |
| | pre-ext. diesel | PAA (32%) | 90 | 20 | 6 | 55 | 1 | 55 | 79 |
| 12 | diesel | PAA (32%) | 90 | 30 | 6 | 55 | 1 | 55 | 64 |
| 13 | diesel | PAA (32%) | 90 | 30 | 6 | 55 | 1 | 55 | 29 |
| 14 | diesel | PAA (32%) | 90 | 20 | 6 | 55 | 1 | 55 | 40 |
| 15 | diesel | PAA (32%) | 90 | 20 | 6 | 55 | 1 | 55 | 19 |
| 16 | diesel | PAA (32%) | 90 | 20 | 6 | 55 | 1 | 55 | 81 |
| 17 | diesel | | | | 10 | 55 | 1 | 55 | 150 |
| | pre-ext. diesel | PAA (35%) | 90 | 20 | 6 | 55 | 1 | 55 | 18 |
| 18 | diesel | PAA (35%) | 90 | 20 | 6 | 55 | 1 | 55 | 47 |
| 19 | diesel | PAA (7%), AA* | 90 | 20 | 6 | 55 | 1 | 55 | 14 |
| 20 | diesel | PAA (7%), Water** | 90 | 20 | 6 | 55 | 1 | 55 | 23 |
| 21 | diesel | PAA (7%) AA* | 90 | 20 | 6 | 55 | 1 | 55 | 17 |
| 22 | diesel | PAA (3.5%) AA* | 90 | 20 | 6 | 56 | 1 | 56 | 15 |
| 23 | diesel | | 90 | 20 | 10 | 55 | 1 | 55 | 218 |
| | pre-ext. diesel | PAA (7%) AA* | 90 | 20x | 6 | 55 | 1 | 55 | 18 |
| 24 | diesel #2 | PAA (7%) AA* | 90 | 24x | 6 | 55 | 1 | 55 | 24 |
| 25 | diesel | PAA (7%) AA* | 270 | 35x | 6 | 55 | 1 | 55 | 18 |
| 26 | diesel | PAA (7%) AA* | 90 | 20x | 6 | 55 | 1 | 55 | 16 |
| 27 | diesel | $H_2O_2$ (7%) AA* | 90 | 20x | 6 | 55 | 1 | 55 | 18 |
| 28 | diesel | $H_2O_2$ (7%) AA* | 90 | 20x | 6 | 55 | 1 | 55 | 18 |

Diesel initial S = 400 ppm;

PAA = peracetic acid

Notes:

For Run 8, the PAA charge was based upon the amount of sulfur in the pre-extracted diesel For Runs 11, 17, and 22 the PAA charge was the same by weight as Run #15. Since the diesel was pre-extracted, the PAA:S ratio was higher Reaction temperature for oxidation of all runs was 85° C.

*Initial oxidant concentration (32-35 wt %) diluted with Acetic acid (AA) to 7 wt %

**Initial oxidant concentration (32-35 wt %) diluted with water to 7 wt %

For runs 26, 27 and 28, oxidation was conducted in the presence of a tungsten catalyst at 1.0 mol % (runs 26, 27) or 1.5 mol % (run 28)

Discussion of Results for Experiments Using Diesel, Pre-Extracted Diesel, or Naphtha Hydrocarbon Material As can be seen from the data in Table 4, the best results are achieved using 20 times the stoichiometric amount (ie 20 mol equivalents) excess of PAA relative to the initial S-content (ca. 400 ppm). Under these conditions final total sulphur contents approximating 10 ppm are achieved.

It will be appreciated by persons skilled in the art that numerous variations and/or modifications may be made to the invention as shown in the specific embodiments without departing from the spirit or scope of the invention as broadly described. The present embodiments are, therefore, to be considered in all respects as illustrative and not restrictive.

The invention claimed is:

1. A process for reducing the sulfur content of a hydrocarbon material containing sulfur compounds to ultra low sulfur levels of <15 ppm, the process comprising:

at least one oxidation step comprising contacting the hydrocarbon material with an oxidant thereby providing oxidized sulfur compounds;

a first extraction step comprising contacting the hydrocarbon material with an aqueous extractant selected from water or brine to allow at least a portion of the oxidized sulfur compounds to be extracted into the aqueous extractant, and separating the hydrocarbon material from the aqueous extractant to give a hydrocarbon material of reduced sulfur content, wherein the oxidant is in stoichiometric excess in an amount of about 10-20 molar equivalent based on the sulfur content of the hydrocarbon material, wherein the first extraction step is followed by one or more extraction steps with an extractant selected from an aqueous extractant of and an ionic liquid (IL) and wherein at least one of the one or more extraction steps following the first extraction step is conducted with an ionic liquid and a final extraction step is conducted with an aqueous extractant, wherein the ionic liquid (IL) is an IL of general composition $Q^+A^-$, wherein $Q^+$is a quarternary ammonium or phosphonium cation and $A^-$is selected from any one of an alkylsulfate anion, an alkylsulfonate anion, an aromatic sulfonate anion, a thiocyanate anion, a bis(trifluormethanesulfonyl)imid anion, or a combination of two or more of such anions, and optionally $A^-$is selected from one or more anions selected from any one of a halide anion, a nitrate anion, a perfluroalkylcarboxylate anion, a hexafluorophosphate anion, an organophosphorous anion, a tetrafluoroborate anion, a carboxylic acid chelated borate anion, a dicyanamide anion, a halogenoaluminate anion or an organohalogenoaluminate anion or a combination of two or more of such anions, selected such that the IL is in a liquid state at the operating temperature and pressure of the process , and wherein the hydrocarbon material containing sulfur compounds is obtained from a refinery stream and is selected from the group consisting of natural gas condensates, light oils, diesel, gasoline, petroleum, jet fuels, and products of coal gasification and liquidification.

2. A process according to claim 1 wherein the aqueous extractant is water.

3. A process according to claim 1 wherein the aqueous extractant is water of different pH levels ranging from basic to acidic.

4. A process according to claim 1 wherein the oxidant and the aqueous extractant are mixed together prior to contacting the hydrocarbon material.

5. A process according to claim 1 wherein at least one of the one or more extraction steps following the first extraction step and before the final extraction step is conducted with an aqueous extractant.

6. A process according to claim 5 wherein the aqueous extractant is water.

7. A process according to claim 1 wherein the step of contacting the hydrocarbon material with the oxidant may be conducted prior to contacting with the extractant or concurrently with contacting with the extractant.

8. A process according to claim 1 wherein the Q+ cation is selected from an alkyl pyridinium cation or a N,N-dialkylated saturated or unsaturated nitrogen heterocycle, a tetra-alkylphosphonium cation, a tetra-alkyl ammonium cation or a combination of two or more of such cations.

9. A process according to claim 8 wherein the N,N-dialkylated saturated or unsaturated nitrogen heterocycle is selected from any one of a di-alkyl pyrrolidinium cation, di- alkyl piperidinium cation, a di-alkyl imidazolium cation, or a combination of two or more such cations.

10. A process according to claim 1 wherein $A^-$is an aromatic sulfonate anion s selected from a p-toluene sulfonate anion, a perfluroalkylsulfonate anion, and a combination of two or more such anions.

11. A process according to claim 1 wherein the ionic liquid is selected from any one of the ionic liquids listed in table 3.

12. A process according to claim 1 wherein the ionic liquid has a miscibility gap when in contact with the hydrocarbon phase sufficient to minimize undesired losses of hydrocarbon from the hydrocarbon phase into the ionic liquid phase.

13. A process according to claim 1 wherein the ionic liquid has a miscibility gap when in contact with the hydrocarbon phase sufficient to minimize settling times for phase separation and dispersion of the ionic liquid into the hydrocarbon phase.

14. A process according to claim 1 wherein the oxidant is selected from any one of an organic peroxy acid, an organic peroxide or an inorganic peroxide or a combination of two or more such oxidants.

15. A process according to claim 14 wherein the organic peroxy acid is a carboxylic acid having 2 or more carbon atoms.

16. A process according to claim 15 wherein the carboxylic acid is peracetic acid.

17. A process according to claim 14 wherein the organic peroxide is t-butyl hydrogen peroxide.

18. A process according to claim 14 wherein the inorganic peroxide is selected from any one of a hydrogenperoxide, a perborate, a persulfate or a combination of two or more such inorganic peroxides.

19. A process according to claim 14 wherein the inorganic peroxide is used in combination with an organic acid.

20. A process according to claim 19 wherein the organic acid is acetic acid.

21. A process according to claim 1 wherein the first extraction step is at ambient temperature and atmospheric pressure.

22. A process according to claim 1 wherein the ratio of hydrocarbon to extractant is about 10:1.

23. A process according to claim 1 wherein the ratio of hydrocarbon to extractant is about 8:1.

24. A process according to claim 1 wherein the ratio of hydrocarbon to extractant is about 5:1.

25. A process according to claim 1 wherein the one or more oxidation steps may precede or follow the first extraction step or the one or more extraction steps.

26. A process according to claim 1 wherein the at least one oxidation step is followed by at least one extraction step.

27. A process according to claim 1 wherein at least one of the oxidation steps is conducted with peracetic acid and at least the first extraction step is conducted with water.

28. A process according to claim 1 wherein at least one oxidation step is followed by at least one aqueous extraction step which is subsequently followed by at least one ionic liquid extraction step which is subsequently followed by at least one aqueous extraction

29. A process according to claim 1 wherein the hydrocarbon substantially comprises natural gas condensate.

30. A process according to claim 1 wherein the hydrocarbon is initially subjected to at least one ionic liquid extraction step prior to at least one oxidation step.

31. A process according to claim 1 wherein the hydrocarbon comprises naphtha or diesel.

32. A process according to claim 1 wherein the ionic liquid (IL) is an IL of general composition Q+A−, wherein Q+is a quarternary ammonium or phosphonium cation and A−is selected from any one of an alkylsulfate anion, an alkylsulfonate anion, an aromatic sulfonate anion, a thiocyanate anion, a bis(trifluormethanesulfonyl)imid anion, or a combination of two or more of such anions.

33. A process according to claim 1 wherein the ionic liquid (IL) is an IL of general composition Q+A−. wherein Q+ is a quarternary ammonium or phosphonium cation and A− is selected from any one of a halide anion, a nitrate anion, a perfluroalkylcarboxylate anion, a hexafluorophosphate anion, an organophosphorous anion, a tetrafluoroborate anion, a carboxylic acid chelated borate anion, adicyanamide anion, a halogenoaluminate anion, an organohalogenoaluminate anion, or a combination of two or more of such anions.

* * * * *